United States Patent [19]

Strickler

[11] Patent Number: 4,679,399

[45] Date of Patent: Jul. 14, 1987

[54] PROTECTION SYSTEM FOR STEAM TURBINES INCLUDING A SUPERHEAT MONITOR

[75] Inventor: Roger D. Strickler, Mt. Pleasant, Pa.

[73] Assignee: Elliott Turbomachinery Co., Inc., Jeannette, Pa.

[21] Appl. No.: 775,875

[22] Filed: Sep. 13, 1985

[51] Int. Cl.[4] ..... F01K 13/02

[52] U.S. Cl. ..... 60/646; 60/657

[58] Field of Search ..... 60/660, 664, 665, 667, 60/646, 657

[56] References Cited

U.S. PATENT DOCUMENTS

| | | | |
|---|---|---|---|
| 1,934,667 | 11/1933 | Harter | 60/660 |
| 4,086,773 | 5/1978 | Kanegae | 60/667 |
| 4,425,762 | 1/1984 | Wakamatsu | 60/667 X |

*Primary Examiner*—Allen M. Ostrager

*Attorney, Agent, or Firm*—Robert P. Hayter

[57] ABSTRACT

Apparatus and a method for protecting a steam turbine from damage due to moisture are disclosed. The temperature and pressure of the incoming steam are monitored to determine if sufficient superheat energy is available to assure that the steam will flow through the turbine in the gaseous phase. The same inputs may be utilized to determine under and over pressure steam conditions. Once a fault condition is detected, operation of the turbine will be automatically interrupted.

8 Claims, 4 Drawing Figures

PROTECTION SYSTEM FOR STEAM TURBINES INCLUDING A SUPERHEAT MONITOR

BACKGROUND OF THE INVENTION

This invention relates to a method and apparatus for protecting a steam-driven turbine from damage caused by moisture particles entering the turbine with the steam. More particularly, the herein invention concerns monitoring the temperature and pressure of the steam to determine that the necessary superheat level is present to assure that all the steam enters the turbine in a gaseous phase.

Presently, many steam turbines use superheated steam as their driving medium and energy source. It is well known that as steam conditions deteriorate and approach saturation, moisture or liquid steam condenses in the turbine stages. The presence of moisture droplets or particles result in erosion of the moving blades and to a lesser degree the stationary diaphrams and nozzles in the turbine. Significant water ingestion can additionally cause damage to thrust bearings, journal bearings, and seals. Replacements of these parts is an expensive and time-consuming repair.

The degree to which steam is superheated may be determined if both the temperature and pressure of the steam are known. With these two parameters, one only has to go to conventional steam tables or to a Mollier chart to verify that the quality of the steam is such that it is superheated, to verify the degree of superheat and to verify the temperature and/or pressure drop the steam may undergo before reaching saturation.

Generally, operators of turbines have a poor understanding of steam quality. Also, during operation, problems and system upsets to, for instance, to a boiler providing steam, occur so fast that the operators do not have enough time to go to a steam table or to a Mollier chart to determine if steam quality is no longer acceptable, and that the turbine should be shut down. Additionally, many plants do not have operators and thus have no moisture protection for the turbine should the steam quality change.

During cold start-up of turbines, the standard practice is to warm up the main steam headers supplying steam to the turbine inlet. This practice is utilized such that all the water in the header is changed to the gaseous state to verify that superheated steam will be provided to the turbine on start-up. This minimizes the amount of moisture induced into and conducted through the turbine. Many times operators fail to realize the importance of this procedure and start turbines with cold steam headers and/or saturated steam.

To overcome the shortcomings of the existing operating procedures, the subject matter in the herein application was developed. The present apparatus and method monitors the steam temperature and pressure at the inlet line to the turbine. The monitored temperature and pressure are then utilized to determine the degree of superheat and the saturation temperature to ascertain whether or not the turbine should be operated. If the turbine should not be operated, the supply of steam to the turbine is interrupted automatically without operator action. The device also acts as a permissive start-up device in that it requires superheated steam to be available at the turbine inlet before the turbine can be started.

Additionally, since the pressure of the incoming steam to the turbine inlet is monitored, the same control signals may be utilized to determine either a low pressure condition or an over pressure condition. The turbine may be shut down in a like manner upon either of these conditions being detected by closing the inlet valve controlling the flow of the steam to the turbine.

SUMMARY OF THE INVENTION

An object of the present invention is to provide apparatus for controlling the operation of a steam turbine.

A further object of the present invention is to provide apparatus for monitoring the quality of steam being supplied to the steam turbine.

It is a yet further object of the present invention to provide automatic apparatus for interrupting operation of a steam turbine upon a determination that the necessary degree of superheat in the driving steam is not present.

It is another object of the present invention to provide apparatus for interrupting operation of a steam turbine should the steam pressure conditions be outside a normal range.

A still further object of the present invention is to provide a method of protecting a steam turbine by controlling operation to maintain certain pressure and superheat conditions.

Other objects will be apparent from the description to follow and the appended claims.

The above objects are achieved according to the preferred embodiment of the present invention by providing a protection system for a steam turbine for assuring operation of the turbine only when the driving steam is superheated, said turbine including trip means for interrupting the supply of steam to the turbine. A pressure sensing means is mounted to sense the pressure of the driving steam and to generate a pressure signal indicative of said pressure. Likewise, a temperature sensing means is mounted to sense the temperature of the driving steam and to generate a temperature signal indicative of said temperature. A logic means is connected to receive the pressure signal and the temperature signal, said logic means acting to compare said signals to ascertain whether the driving steam is superheated to exceed a threshold level, and said logic means generating a fault signal if the driving steam superheat does not exceed the threshold level. Energization means are connected to receive the fault signal, and in response thereto, to energize a trip means to interrupt the flow of steam to the turbine.

Also disclosed is a method of automatically protecting a steam turbine from potential damage caused by liquid water in a steam supply to the turbine. The method includes the steps of sensing the pressure of the steam supply, sensing the temperature of the steam supply, comparing the sensed temperature and pressure to ascertain the amount of superheat in the steam supply, and interrupting the flow of the steam supply to the turbine should the step of comparing determine that the amount of superheat is below a threshold level selected to assure the steam supply contains no liquid water.

DESCRIPTION OF THE PREFERRED EMBODIMENT

Apparatus and a method will be described hereafter for interrupting steam flow to a turbine to prevent turbine operation under certain conditions. It is to be understood that this method and apparatus has applicability to other types of turbomachinery. It is further to be understood that although in one embodiment discrete circuit components are shown that it is conceivable that all the functions accomplished therein could be accomplished in a programmed microprocessor. It is further to be understood that these programmed functions could be but one of many subroutines in an overall master control.

Figure 1:
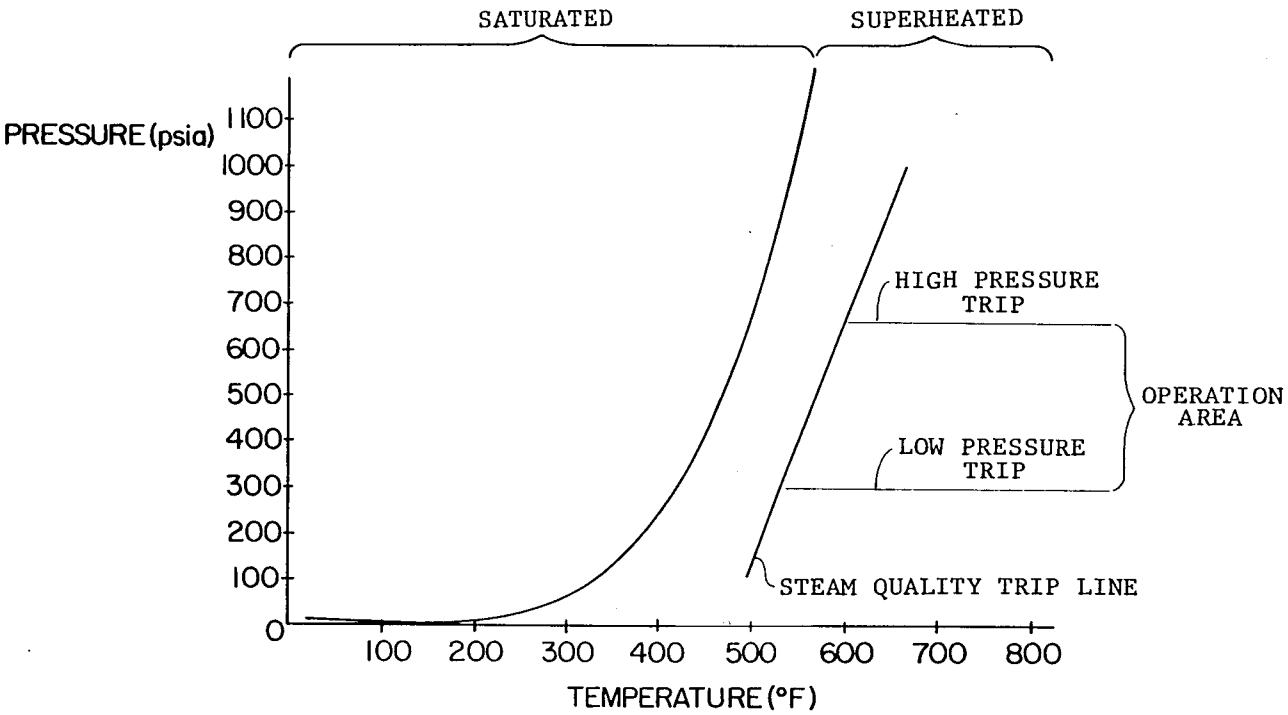
FIG. 1 is a Mollier chart showing steam phases for various temperature and pressure conditions.

Referring first to FIG. 1, there may be seen a Mollier diagram plotting pressure against temperature. In this diagram the area labeled "saturated" is separated from the area labeled "superheated" by a saturation line. Steam to the left of the saturation line is part liquid and steam to the right of the saturation line is all gas. A steam quality trip line is shown as would be ascertained by comparing the temperature and pressure conditions at the steam inlet to the turbine. Additionally, a high pressure trip line and a low pressure trip line are shown to indicate the maximum and minimum pressures at which the turbine may be operated. The space to the right of the steam quality trip line and between the two pressure lines represents the operation area in which the turbine may be safely operated. This particular operation area was plotted based on a turbine having design operating steam conditions of 825° F. and 600 psig. The low pressure trip level is set at 300 psig and the high pressure trip level at 660 psig.

The steam quality trip line is a straight line positioned to reflect about 100° F. of superheat above the saturation line. It is assumed that with 100° F. of superheat at the steam inlet there will be no condensation of the steam within the turbine.

Although the steam quality trip line is a straight line, the saturation line is curvilinear. However, as pressure and temperature conditions change from the design area it may be seen that the temperature differential between the saturation line and the steam quality trip line increases adding to the overall degree of safety and further assuring that if the conditions detected are to the right of the steam quality trip line there will be no condensation within the turbine. If the temperature and pressure conditions detected fall on the left side of the steam quality trip line the control will interrupt the supply of steam to the turbine.

Figure 2:
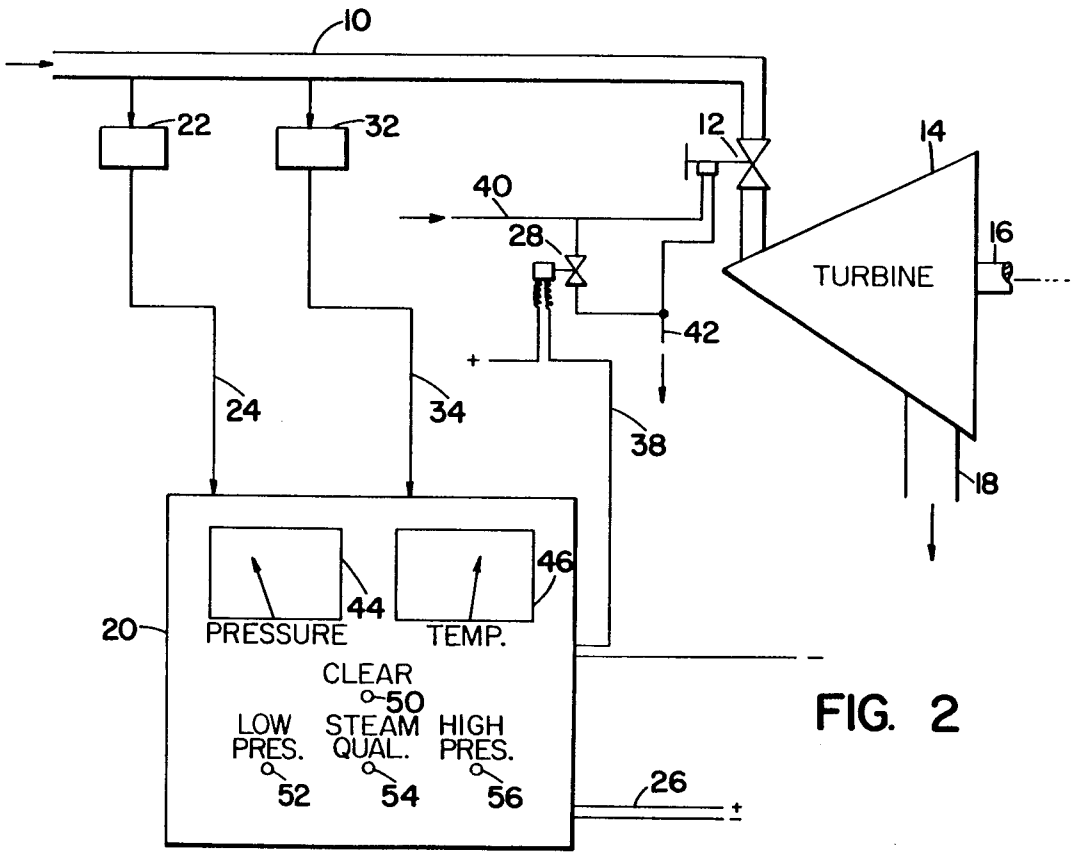
FIG. 2 is a schematic diagram of the protection system disclosed herein.

FIG. 2 shows a schematic arrangement of the protection system. It may be seen that steam is supplied through steam supply line 10, through trip and throttle valve 12 to the inlet of turbine 14. The steam travels through turbine 14 and is discharged through steam exhaust 18. Energy in the steam is converted to mechanical shaft work to drive shaft 16 by the turbine.

Pressure transducer 22 is connected to monitor the pressure of the steam in supply line 10 and generates a signal indicative of the sensed pressure which is carried over wire 24 to control 20. Similarly, temperature transducer 32 is connected to monitor the temperature in steam supply line 10 and generates a signal indicative of the sensed temperature which is carried over wire 34 to control 20. Control 20 is a device which may contain appropriate discrete electronic circuitry or a microprocessor and various interface devices to accomplish the control function herein.

A typical exterior view of the control may be seen to have pressure meter 44 and temperature meter 46 indicating the pressure and temperature sensed by the pressure transducer and the temperature transducer, respectively. Additionally, the face of control 20 may include a series of light emitting diodes, bulbs, or other indicators. When energized, clear reference indicator 50 advises that there are no fault conditions detected, indicator 54 provides a warning that the steam quality is incorrect (too much moisture or not enough superheat), indicator 56 provides a warning that the steam pressure is too high, and indicator 52 provides a warning that the steam pressure is too low.

Power is supplied to the control via power supply 26. Control 20 sends a control signal upon a fault condition being detected which is carried over wire 38.

Trip and throttle valve 12 is actuated with pressurized oil received from oil supply 40. Oil flows under pressure to the valve to maintain it in the open position. Should it be desired to close the valve, then solenoid valve 28 is opened providing a bypass path for the oil supply to oil drain 42. Under these conditions, the pressure of the oil supply at trip and throttle valve 12 is reduced allowing the valve to close thereby interrupting the flow of steam to the turbine. Solenoid valve 28 is energized via the signal on wire 38. As shown, the power circuit for the solenoid valve may be interrupted by control 20 to allow solenoid valve 28 to become de-energized.

Figure 3:
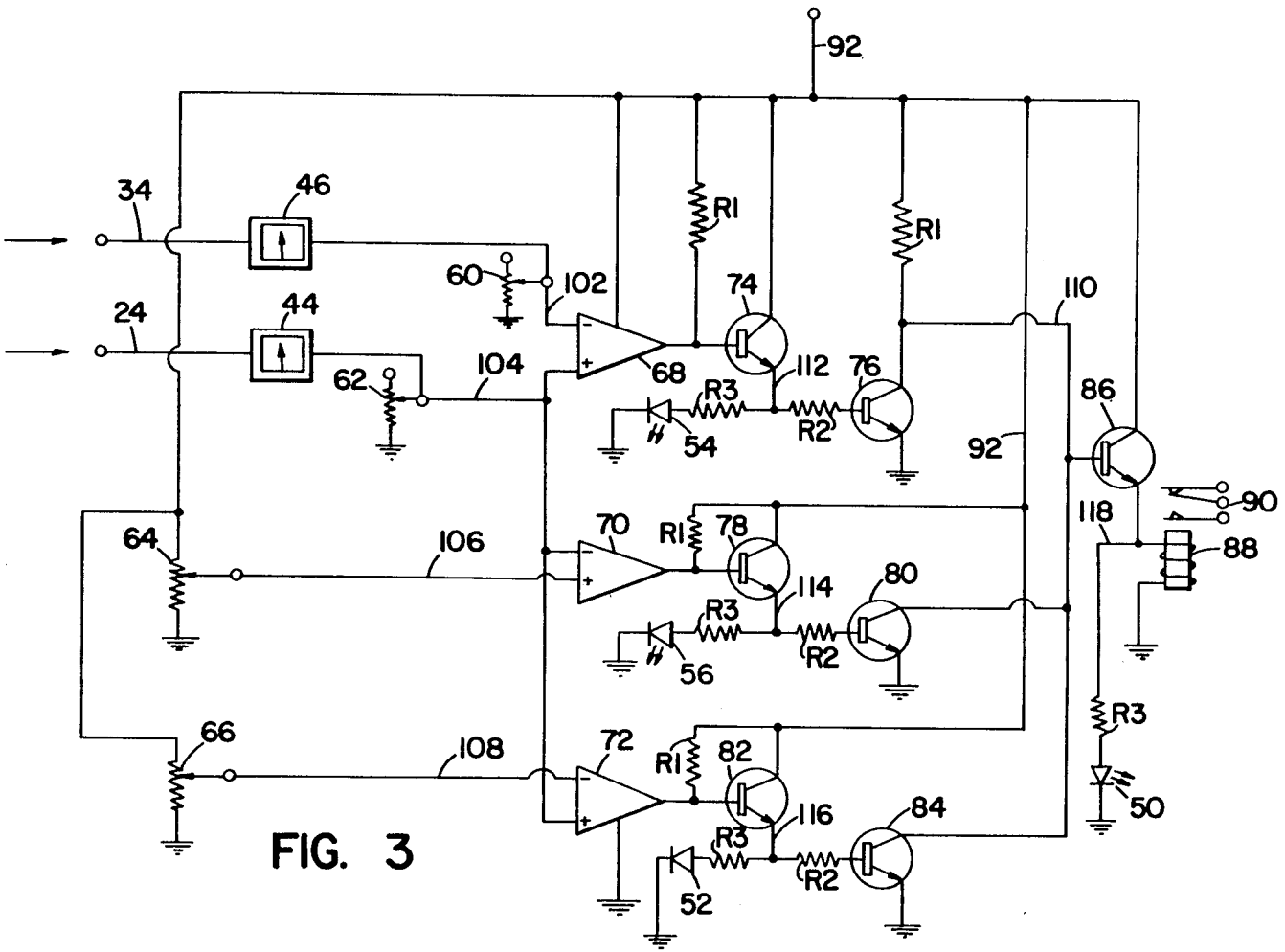
FIG. 3 is an electrical schematic diagram of a circuit designed to accomplish the logic functions of the protection system.

FIG. 3 is an electrical schematic of a discrete component embodiment of the control logic showing the components and appropriate connections to accomplish the desired function. On the left-hand side of FIG. 3 it may be seen that wires 34 and 24 enter the control, these being the same wires that carry the appropriate signals from the pressure transducer and the temperature transducer 22 and 32, respectively. Wires 24 and 34 are shown connected to pressure meter 44 and temperature meter 46 as shown in FIG. 2.

Power is supplied through wire 92 to the circuit of FIG. 3. This power is supplied to transistors 74, 76, 78, 80, 82, 84, and 86 as well as to variable resistors 64 and 66.

The signals generated on wires 34 and 24 are representative of the temperature and pressure detected and are appropriately conditioned at variable resistors 60 and 62. The variable resistors are set such that the direct comparison of the absolute value of the separate signals may be used to determine if the level of superheat in the steam exceeds the desired threshold level. Comparator 68 acts to compare the absolute value of the temperature signal with the absolute value of the pressure signal. Should the absolute value of the pressure signal exceed that of the temperature signal, then it is determined that insufficient superheat is present and it is desirable to interrupt the flow of steam to the turbine.

Variable resistors 60 and 62 may be manually set to identify the minimum appropriate superheat level for the specific system involved. Under normal operating conditions there will be sufficient superheat and the comparator will indicate that the temperature signal is higher than the pressure signal and consequently the comparator will not generate an output signal. Under these conditions the base of transistor 74 is not energized and transistor 74 is therefore not conductive. In like manner transistor 76 is not conductive. When transistor 76 is not conductive, current flows through wire 92 to wire 110, and through wire 110 energizes the base of transistor 86 allowing current flow therethrough to solenoid coil 88, which acts to move contacts 90 thereby maintaining solenoid 28 energized. Additionally, current flows through wire 118, and through resistor R-3 to light emitting diode 50 which indicates a clear condition on the front of control 20.

Should, however, the necessary degree of superheat not be present, then the pressure signal will be greater in absolute value than the temperature signal and the comparator will generate an output signal. This output signal will act to energize the base of transistor 74 which will make transistor 74 conductive. This, in turn, energizes wire 112 which will energize light emitting diode 54 indicating a steam quality fault on the face of control 20. Additionally, through wire 112, the base of transistor 76 is energized. This makes transistor 76 conductive which grounds wire 110 thereby preventing any potential from being applied to the base of transistor 86. Hence, transistor 86 becomes nonconductive and relay coil 88 is de-energized such that contacts 90 become de-energized and the solenoid valve 28 opens allowing the oil to drain and the trip and throttle valve to close thereby terminating the flow of steam to the steam turbine. In the manner described, the simple comparison of the absolute value of the appropriate signals acts to close the trip and throttle valve.

In like manner the low and high pressure conditions are sensed and utilized to de-energize transistor 86. Variable resistors 64 and 66, are used to apply a predetermined potential to comparators 70 and 72 to set the trip level for low pressure and high pressure conditions. Power is supplied through wire 92 to variable resistor 64. A specific resistance is selected to achieve the appropriate signal level on wiplied through wire 92 to variable resistor 64. A specific resistance is selected to achieve the appropriate signal level on wire 106 which is compared to the pressure signal from wire 104. If the pressure signal from wire 104 exceeds the high pressure signal on wire 106, then comparator 70 generates an output signal which energizes the base of transistor 78. Transistor 78 then becomes conductive and energizes light emitting diode 56 indicating a high pressure condition, and energizes the base of transistor 80. Transistor 80 becomes conductive thereby grounding wire 110 and taking the potential from the base of transistor 86. As set forth above, the flow of steam to the turbine is then interrupted by closing the trip and throttle valve.

The low pressure protection device works in a similar manner. The low pressure level is set at variable resistor 66 and the appropriate low pressure signal is carried over wire 108 to comparator 72 where it is compared with the actual pressure signal from wire 104. Should the pressure become too low, then the comparator generates a signal which energizes the base of transistor 82 making it conductive such that light emitting diode 52 is energized and such that power is supplied to the base of transistor 84 grounding out wire 110, thereby making transistor 86 nonconductive and de-energizing solenoid valve 22 which closes trip and throttle valve 12.

It may be seen that this circuit is designed such that a loss of power leaves the solenoid valve open which causes the trip and throttle valve to close interrupting steam flow to the turbine.

Figure 4:
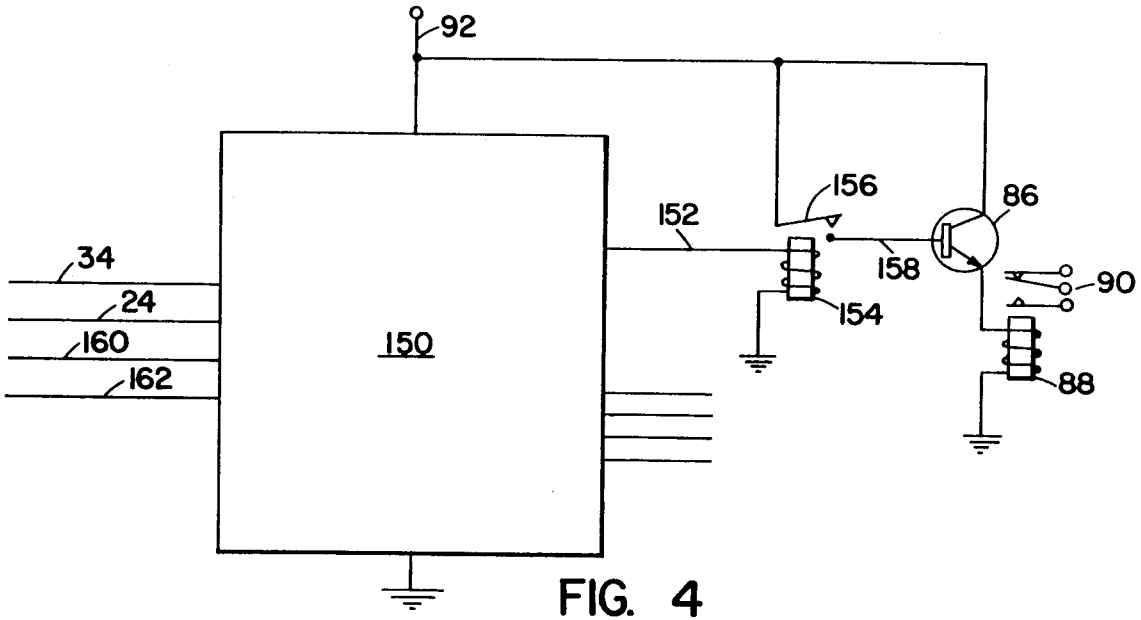
FIG. 4 is a circuit diagram similar to FIG. 3 showing a microprocessor performing the function of the discrete circuit elements of FIG. 3.

FIG. 4 is a simplified view of a microprocessor incorporating the logic of the circuit shown in FIG. 3. The pressure and temperature signals enter the microprocessor over wires 34 and 24. Additionally, a high pressure signal and a low pressure signal are supplied over wires 160 and 162 to microprocessor 150. The microprocessor has a series of outputs one of which would be wire 152. Should a fault condition be detected based upon inputs 34, 24, 160, and 162 and based upon the programmed logic contained within the microprocessor or other similar computing device, then an appropriate output on wire 152 would be generated.

Wire 152 will act to energize relay coil 154 which closes contacts 156 thereby applying potential to the base of transistor 86 making it conductive and energizing contacts 90 through relay 88. Hence, in the normal mode of operation output 152 would be energized.

However, should a fault be detected then output 152 would be de-energized thereby de-energizing relay 154 allowing contacts 156 to open. In this manner, power would not be supplied over wire 158 to the base of transistor 86 and hence transistor 86 would be nonconductive thereby de-energizing relay coil 88 and opening contacts 90. In this mode, the trip and throttle valve will close interrupting the flow of steam to the turbine.

In addition to variable resistors 60 and 62, another means of regulating the valve of the temperature and pressure inputs is to calibrate the temperature and pressure transducers accordingly.

The solenoid valve for controlling the trip and throttle valve herein is described as being energized to be open. An equivalent fail-safe system would have the solenoid de-energized to be open such that loss of power results in interruption of steam flow to the turbine.

The invention has been described herein with reference to specific embodiments for achieving the function indicated. It is to be understood by those skilled the art that variations and modifications can be effected within the spirit and scope of the invention.

What is claimed:

1. A protection system for a steam-driven turbine for assuring operation of the turbine only when the driving steam is superheated, said turbine including trip means for interrupting the supply of steam to the turbine, which comprises:

pressure sensing means mounted to sense the pressure of the driving steam and to generate a pressure signal indicative of said presure;

temperature sensing means mounted to sense the temperature of the driving steam and to generate a temperature signal indicative of said temperature;

logic means connected to receive the pressure signal and the temperature signal, said logic means including signal conditioning means for adjusting the value of the temperature and pressure signals;

comparator means connected to receive the temperature signal and the pressure signal after they have been conditioned and for generating an output fault signal when the absolute value of the conditioned pressure signal exceeds the absolute value of the conditined temperature signal; and energization means connected to receive the fault signal and in response thereto to energize the trip means to interrupt the flow of steam to the turbine.

2. The apparatus as set forth in claim 1 wherein the energization means is a solenoid which is energized through a normally conductive switch means, wherein the fault signal is connected to the switch means to make it nonconductive upon the detection of a fault such that the solenoid becomes de-energized thereby energizing the trip means to interrupt the flow of steam to the turbine.

3. The apparatus as set forth in claim 2 and further comprising a transistor network including a first transistor and a second transistor connected to receive the output signal of the comparator, said output signal biasing the first transistor "on" and said first transistor biasing said second transistor "on", said second transistor being connected to ground and to the source of power used to bias the normally conductive switch means "on" such that when the second transistor is biased "on" the switch means is turned "off".

4. The apparatus as set forth in claim 1 wherein the logic means further comprises:

a low pressure means for comparing the pressure signal to a reference low pressure signal;

a high pressure means for comparing the pressure signal to a reference high pressure signal; and said logic means generating a fault signal if the pressure signal is lower than the reference low pressure signal or if it is higher than the reference high pressure signal.

5. The apparatus as set forth in claim 1 wherein the logic means is a programmed computer.

6. A method of automatically protecting a steam turbine from potential damage caused by liquid water in the steam supply to the turbine which comprises the steps of:

sensing the pressure of the steam supply;

sensing the temperature of the steam supply;

comparing the sensed temperature and pressure to ascertain the amount of superheat in the steam supply by conditioning signals representative of the sensed temperature and the sensed pressure and comparing the absolute value of the conditioned signals to determine if the threshold level of superheat is present; and interrupting the flow of the steam supply to the turbine should the step of comparing determine that the amount of superheat is below a threshold level selected to assure the steam supply contains no liquid water.

7. The method as set forth in claim 6 and further comprising the steps of:

determining if the sensed pressure is lower than a low pressure threshold or is higher than a high pressure threshold; and interrupting the flow of the steam supply to the turbine should the step of determining indicate that the sensed pressure is below the low pressure threshold or exceeds the high pressure threshold.

8. The method as set forth in claim 7 and further comprising the steps of:

energizing an indicator when the step of interrupting occurs to display if the step of interrupting is based on the superheat being below the threshold level, the pressure being below the low pressure threshold or the pressure being above the high pressure threshold.

* * * * *